United States Patent [19]

Schirmer

[11] 4,249,659

[45] Feb. 10, 1981

[54] HEAT SHRUNK PACKAGE

[75] Inventor: Henry G. Schirmer, Spartanburg, S.C.

[73] Assignee: W. R. Grace & Co., Duncan, S.C.

[21] Appl. No.: 36,917

[22] Filed: May 7, 1979

Related U.S. Application Data

[63] Continuation of Ser. No. 895,202, Apr. 10, 1979, abandoned.

[51] Int. Cl.[3] ..... B65D 65/04; B65D 85/00

[52] U.S. Cl. ..... 206/471; 229/DIG. 12

[58] Field of Search ..... 206/45.34, 461–466, 206/470, 471, 484, 497, 524.8, 526; 229/DIG. 12

[56] References Cited

U.S. PATENT DOCUMENTS

| | | | |
|---|---|---|---|
| 3,127,993 | 4/1964 | Phipps | 206/462 |
| 3,516,537 | 6/1970 | Dreyfus et al. | 229/DIG. 12 |
| 3,679,048 | 7/1972 | Fujio | 229/DIG. 12 |
| 3,776,375 | 12/1973 | Rohdin | 206/45.34 |
| 3,863,837 | 2/1975 | Spiegel et al. | 229/DIG. 12 |

FOREIGN PATENT DOCUMENTS

| | | | |
|---|---|---|---|
| 420536 | 3/1967 | Switzerland | 206/471 |

*Primary Examiner*—Davis T. Moorhead

*Attorney, Agent, or Firm*—John J. Toney; William D. Lee, Jr.; Joseph P. Harps

[57] ABSTRACT

A package and a method of producing a package by forming a pocket in the central portion of a sheet of wrapping material, preferably a thermoplastic film, placing a product within the pocket, folding the flat portions of the film into face-to-face contact and bonding the flat portions together. The package can also be evacuated and hermetically sealed. If the film has been oriented, the pocket may be heat shrunk.

2 Claims, 6 Drawing Figures

HEAT SHRUNK PACKAGE

BACKGROUND OF THE INVENTION

This invention relates generally to the art of packaging and more particularly to the art of producing a package by forming a pocket in a sheet of wrapping material, placing a product in the pocket, and sealing the material to enclose the product.

Various methods have heretofore been used for forming packages. The one commonly used method requires prefabricated, heat shrinkable bags or pouches and a filling operation which is followed by subsequent evacuating, closing of the bag and then shrinking the bag about the product if desired.

U.S. Pat. No. 3,956,867 to Kastulus Utz et al describes the formation of a shrinkable pouch in a first foil, putting the commodity to be packed into the space between the pouch and a second foil, sealing both foils together and shrinking the first foil in the area of the pouch.

Another method known in the art as skin packaging is shown in U.S. Pat. No. 3,736,721 issued to Robert O. Wolfelsperger which shows a film drawn into a cavity and held there while the product is placed in the film cavity after which the cavity is evacuated and the vacuum released so that the single sheet collapses around the product making a peripheral seal.

Various approaches have been taken in an attempt to provide improved methods for producing display packages. One of the better known is a blister type package; for example, U.S. Pat. No. 3,776,375 to Howard A. Rohdin which shows preforming a blister enclosure from a unitary piece of plastic sheet material by forming the enclosure in two opposed mating sections integrally joined along a fold line which traverses the base portion. Flanges are formed along the free edges of each of the two sections to provide means for securing them together around the product to be packaged.

The present invention provides a new process and package in which the advantages of skin, bubble, and bag packaging are incorporated into a single package. With this invention the simplicity and economics are even greater than those of skin packaging. As in bubble packaging and bag packaging the present packaging method can be employed without first making a substantial investment in packaging equipment. In addition, this process produces a package in which the product may selectively project from and be visible from either one or all sides of the finished package and yet be covered completely by a protective pocket of plastic film.

SUMMARY OF THE INVENTION

In one aspect of the present invention, a product or article or a plurality of products or articles are enclosed in a wrapping material; e.g., thermoplastic film or paper, by the steps which comprise forming a pocket or cavity in a sheet of the material, placing a product in the pocket, folding the resultant flange portions of the sheet so that the flange portions of the film sheets are in a face-to-face relationship, and bonding at least portions of the flanges together. In another embodiment the pocket may be evacuated prior to completing the seal.

Another aspect of the invention comprises forming a heat shrinkable pocket and then subsequent to evacuating the pocket, shrinking the pocket about the product.

In another aspect, the present invention provides a package having a product or article enclosed within a thermoplastic film which tightly conforms to the shape of the product and which film is seamless for at least one half of the periphery of the product, the film extending beyond the periphery of a portion of the product to form an extension or flange of two layers of film bonded together.

Still another aspect of the invention comprises forming a means on the package for displaying the packaged product.

The invention may be better understood by reference to the drawings described below and the following description.

BRIEF DESCRIPTION OF THE DRAWINGS

In the drawings which are appended hereto and made a part of this disclosure.

DETAILED DESCRIPTION

Figure 1:
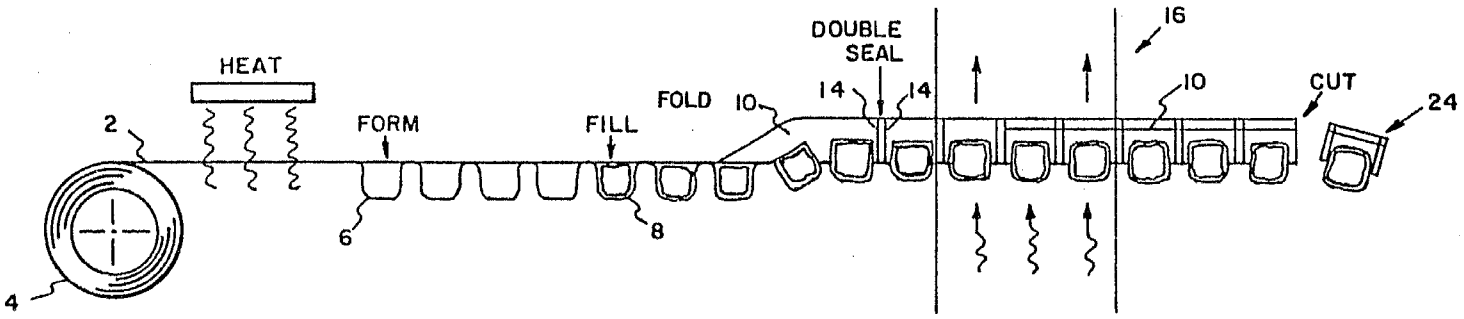
FIG. 1 is a diagrammatic representation of a preferred embodiment of the process of this invention.

FIG. 1 schematically illustrates the process steps of producing an evacuated package. A web 2 of a sheet of wrapping material; e.g., paper but preferably a flexible thermoplastic film, is advanced forward from a supply roll 4, a pocket 6 is formed in the transversely center portion of the material and product 8 is placed in the formed pocket. The pocket may be formed by any effective means; e.g., heat is applied and the center portion is stretched by positive or negative pressure to form a pocket. The film forming the pocket may be heat shrinkable provided the heat and degree of stretch are selected to cause orientation in the film. One or more products or articles are then placed into the pocket. The material is centerfolded so that the flat flange portions 10 of the material surrounding the pocket are in a face-to-face relationship and the sides of the sheet material are bonded or heat sealed together along seals 14. In many instances the top edges are also sealed. However, if it is desirable to evacuate or gas flush the air from the package, it will preferably take place prior to sealing the top edge. A simplified step of evacuating is illustrated using a continuous vacuum in chamber 16; however, it is to be understood that any suitable means for evacuating or gas flushing the pocket may be employed. If the film of the pocket has been oriented and it is desired to shrink it, any suitable means may be used including contact with hot air or hot water for shrinking the pocket about the product or products when desired; i.e., heat can be applied to the pocket inside the vacuum chamber 16 causing the stretched pocket to shrink about the product which can be performed subsequent to evacuation or performed simultaneously with evacuation. Further, for the sake of simplicity, the process is shown drawing a sheet of material 2 horizontally forward from a supply roll 4 and after forming and filling the pocket, folding the sheet upwardly so that the flat portions of the sheet are in a face-to-face relationship, heat sealing the sides together and evacuating the pocket through the open top 18, closing the top with heat seal 20 and then shrinking the pocket about the product. The successively formed packages may or may not be subsequently severed from the continuous web of material. Illustrated in FIG. 1, a cut is made to form an individual evacuated package 24.

Figure 2A:
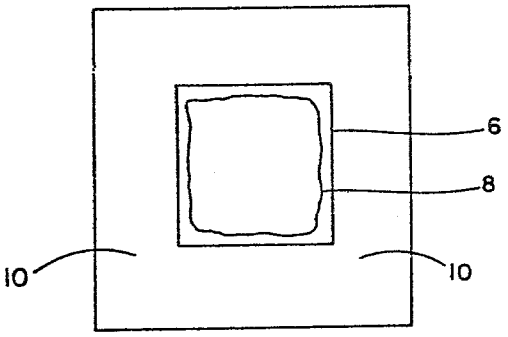
FIGS. 2*a*, 2*b*, and 2*c* are top plan views illustrating the step by step formation of the package.
Figure 3A:
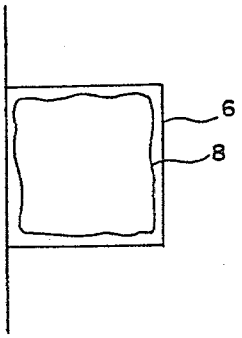
FIGS. 3*a*, 3*b* and 3*c* are corresponding side views of FIGS. 2*a*, 2*b* and 2*c* respectively.
Figure 2B:
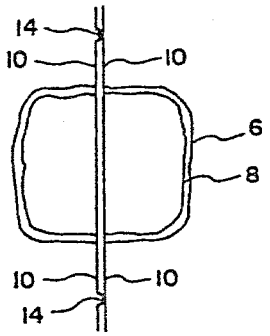
Figure 3B:
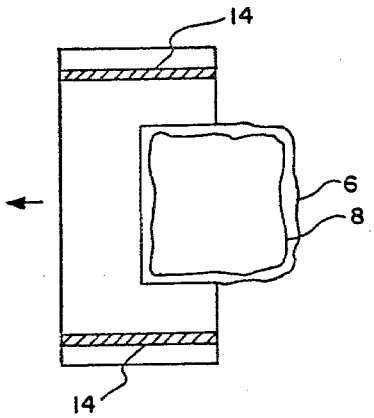
Figure 2C:
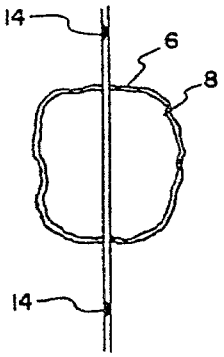
Figure 3C:
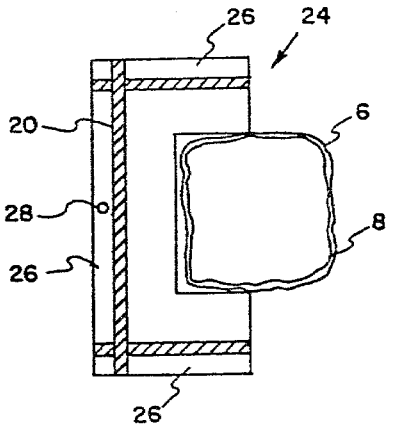

As stated hereinbefore, FIGS. 2*a* through 2*c* (top view) and corresponding FIGS. 3*a* through 3*c* (side view) show the forming stages of a sheet of film to produce an evacuated package with a product contained therein. FIGS. 2*a* and 3*a* show a product 8 in pocket 6 formed in a sheet of film 2. FIGS. 2*b* and 3*b* illustrate the package with the flat flange portions of the film in a face-to-face relationship with the sides bonded together along seals 14. FIGS. 2*c* and 3*c* show an evacuated package 24 with pocket 6 shrunk about product 8.

Figure 4:
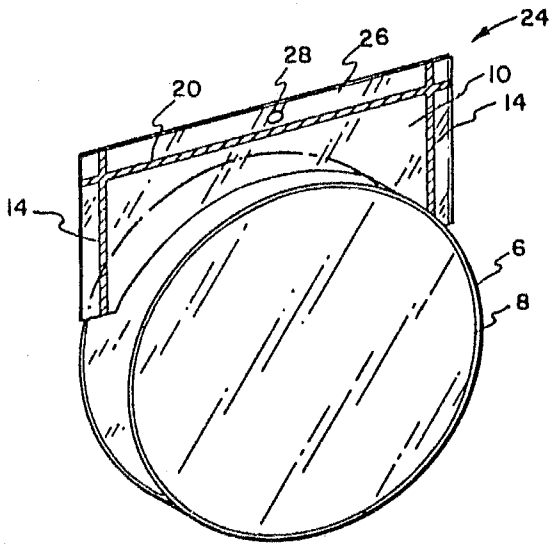
FIG. 4 is a view in perspective of a package constructed in accordance with this invention.

As shown in FIG. 4, a package 24 with a product or article 8 contained in thermoplastic film which covers and tightly conforms to the product. The film extends beyond the product, to form a flange or extension 10 adjacent only a portion of the product.

The heretofore described package can easily be a package for displaying all sides of a product contained therein by using a transparent wrapping material such as transparent thermoplastic film. Further, by bonding or sealing the sides and top of the flat, face-to-face portions of the film a distance inwardly from the edges of the package to allow for tabs 26 which are not bonded or sealed together provides a border outside of the evacuated area for aperture or apertures 28 for hanging the package to display the packaged product on one or all sides.

EXAMPLE

The following example illustrates the method of packaging a food product utilizing a laminated film. It has been found that the use of a laminated sheet of film having a layer impermeable to oxygen, a flexible film layer readily heat sealable and a third support layer has been particularly advantageous in providing a shelf-stable food product. However, in this respect, it should be understood that the following example is merely illustrative of the present invention and should not be construed as limited thereto.

A laminated film sheet as above described was clamped and heat applied to the center portion thereof. The heated portion was vacuum formed to form an oriented pocket. The sheet of film was clamped so that the inner surface of the pocket was the heat sealable layer. A piece of meat was placed in the pocket, the sheet of film then centerfolded so that the flat portions of the sheet were in a face-to-face relationship and sealed on two sides. The partially sealed package was then evacuated through the opening at the top and a final top seal made to form a hermetically sealed package. The pocket was shrunk tight to the product by immersing the package in hot water thereby providing a package without any folds or pleats which are potential problem areas since they are locations which can present leakage and contamination problems.

The principles of the present invention are not limited solely to packaging food products, although due to the hermetic sealing conditions readily established during packaging, the present method is particularly adapted for food product packaging. However, any products or articles may be packaged using the present method. Furthermore, the novel method of the present invention can be employed for the fabrications of packages with a wide variety of wrapping materials, including thermoplastic polymeric materials. Instead of heat sealing, the top and side edges can be glued together with a suitable adhesive.

Since it is obvious that various changes and modifications can be made in the above-description without departing from the nature and spirit thereof, this invention is not restricted thereto except as set forth in the appended claims.

The embodiments of the invention in which an exclusive property or privilege is claimed are defined as follows:

1. A package comprising:

(a) an article;

(b) a single thermoplastic film sheet enclosing said article, said film sheet comprising:

(1) a shrunken portion closely conforming to the shape of said article, said shrunken portion having been previously stretched, and (2) a flange portion comprising sealed together edge portions of said sheet which seal closes said article containing shrunken portion, said flange being continuous on one side of said package and extending around approximately one half of said article, the edge portions which comprise said flange being substantially unstretched and non-shrunken.

2. The package of claim 1 wherein the shrunken, article containing portion is hermetically closed by said flange and the article containing space is evacuated.

* * * * *